United States Patent [19]

Åström et al.

[11] Patent Number: 4,876,961

[45] Date of Patent: Oct. 31, 1989

[54] FUZES

[75] Inventors: Bert Åström, Degerfors; Olof Nygårds, Karlskoga, both of Sweden

[73] Assignee: Aktiebolaget Bofors, Bofors, Sweden

[21] Appl. No.: 253,631

[22] Filed: Oct. 6, 1988

[30] Foreign Application Priority Data

Oct. 6, 1987 [SE] Sweden ..... 8703840

[51] Int. Cl.[4] ..... F42C 15/34

[52] U.S. Cl. ..... 102/254; 102/222

[58] Field of Search ..... 112/254, 247, 222, 221, 112/216, 252

[56] References Cited

U.S. PATENT DOCUMENTS

| | | | |
|---|---|---|---|
| 3,148,621 | 9/1964 | Varaud | 102/252 |
| 4,286,521 | 9/1981 | Marer | 102/254 |
| 4,573,411 | 3/1986 | Liebhardt et al. | 102/254 |
| 4,739,705 | 4/1988 | Hudson et al. | 102/222 |
| 4,770,096 | 9/1988 | Maruska et al. | 102/254 |

*Primary Examiner*—David H. Brown

*Attorney, Agent, or Firm*—Pollock, Vande Sande & Priddy

[57] ABSTRACT

An ammunition unit has a fuze which includes an electrical trajectory safety device for preventing arming of the ammunition unit within a trajectory safety distance. An arming igniter actuable by the electrical trajectory safety device activates a movable portion for execution of an instantaneous movement to move a bursting cap disposed in the movable portion into an arming position in register with the initiation detonator included in a detonation chain and actuable by an impact or a proximity fuze contact. The movable portion is lockable by a locking pin, which is actuable on a retardation of the ammunition unit caused by a first hit of the ammunition unit against a first object located within the trajectory safety distance. Upon actuation, the locking pin locks the movable portion to prevent it from executing the instantaneous movement, even if the first hit were to cause mechanical action on the electronics which effects actuation of the arming igniter. The ammunition unit, on a second hit, assumes a safe position such that the total bursting of the ammunition unit through the intermediary of the bursting cap is prevented.

10 Claims, 2 Drawing Sheets

FUZES

TECHNICAL FIELD

The present invention relates to a fuze arrangement for an ammunition unit fireable from a gun, the fuze comprising electronics with an associated electrical trajectory safety device which prevents arming of the ammunition unit within a trajectory safety distance, and an arming detonator which is triggerable by the trajectory safety device after the trajectory distance and is intended for a movable part, for example a rotor or slide, which, on triggering of the arming safety device executes an instantaneous movement in which it displaces a blasting cap disposed in the movable portion to its arming position in register with an initiation detonator which in turn, is included in an ignition chain which may be activated by means of a contact, for instance an impact contact, proximity fuze contact, etc.

BACKGROUND ART

Similar types of fuzes are previously known in the art. The trajectory safety is intended to activate the arming igniter within a trajectory safety distance which may be selected at between 50 and 150 meters from the muzzle of the gun. The trajectory safety device may receive activation in conjunction with the movement in the barrel of the gun, for example with the aid of induction, and in addition the trajectory safety contact operates with a certain time lag which ensures the above-mentioned trajectory safety distance. The trajectoy safety device may also be activated mechanically by the acceleration which occurs in conjunction with firing of the gun. The arming igniter may be of that type which utilizes a locking pin which locks the slide to a fixed portion in the ammunition unit on the movement thereof in the trajectory safety region. The pin is displaced from its engagement with the fixed portion or the movable portion with the assistance of an ignition charge which may be activated by means of the above-mentioned electric trajectory safety device. The initiation detonator may also be electrically initiated. on activation of the arming detonator, the movable portion (the rotor) executes an instantaneous movement during a few milliseconds when the detonation cap is moved to its arming position in register with the initiation detonator which may be activated by means of the impact contact or the like. The electronics of the fuze, like the design of ignition charges, contacts etc. are previously known in the art.

TECHNICAL PROBLEM

It is vital that the ammunition unit is not detonated within the region of the trajectory safety distance, int. al. because there are inflexible demands that the gun crew be protected from such explosions. However, firing may take place in a terrain where objects are located within the region of the trajectory safety distance, for example, trees, buildings etc. In electrically triggerable fuzes, there is the risk that if the ammunition unit hits an object within the trajectory safety distance, the electronics of the unit will be destroyed so that the continued sequence of events becomes uncontrollable. For instance, the mechanical influence on the electronics in the event of such a hit could cause the arming detonator to be activated and the detonation cap to be moved to its armed position. In the event of a subsequent additional hit against another object within the trajectory safety distance, the detonation cap could, consequently, be shock-ignited, which would result in complete explosion of the ammunition unit within the trajectory safety distance.

There is therefore a manifested need in the art to prevent, in fuzes operating with electric trajectory safety devices, explosions of the above-discussed type within the trajectory safety distance.

SUMMARY OF THE INVENTION

The primary object of the present invention is to provide a fuze arrangement which solves the above-outlined problem. In the present invention fuze arrangement, the movable portion is lockable by means of a locking device, for example in the form of a pin-like device, which is actuable on a non-shock-triggering first hit of the ammunition unit against a first object located within the trajectory safety distance, the object possibly consisting of a tree, a building etc. Further characterizing features of the arrangement according to the present invention are that the locking device, on its activation upon the first hit, will lock the movable portion which is thereafter prevented from executing the instantaneous movement, even if the first hit were to cause such mechanical influence to the electronics that entails activation of the arming igniter, and the ammunition unit, on a non-shock-triggering second hit against a further object within the trajectory safety distance, would assume a safe position, thereby preventing triggering of the ammunition unit because the detonation cap is shock-detonated upon the second hit.

In further developments of the inventive concept as herein disclosed, the pin-like device is disposed in a first recess in the movable portion. The recess extends in the longitudinal direction of the ammunition unit. This first recess is then disposed facing a second recess in a fixed portion included in the ammunition unit. The pin-shaped device may be arranged, for a retardation caused by the first hit, to be activated for its operation where it enters into engagement with the first portion in that it is displaced with respect to the firt portion and penetrates, with its forward region, into the second recess and thus locks the movable portion to the fixed portion.

The pin-shaped device is preferably disposed in its recess with a clearance which may consist of a few hundredths of a millimeter. Hence, the pin-shaped device is essentially loosely displaceable in the recess with the aid of the retardation. The second recess displays a diameter which exceeds the diameter of the first recess. The diameter of the second recess may exceed that of the first recess by, for instance, 10–30 percent. The first and second recesses are disposed opposite one another in an initial position of the moving portion, such that the center lines of the recesses substantially coincide.

In the case involving a rotor, the pin-shaped device and the recesses are located beside the axis of rotation of the ammunition unit. The pin-shaped device locks the movable portion to the fixed portion in that the portion interact with side surfaces on the pin-shaped device with the assistance of the rotational forces in the ammunition unit.

The arrangement according to the present invention provides a simple solution to a technically difficult problem by the use of a loosely inserted pin-shaped device. The acceleration forces in the ammunition unit on its discharge from the gun will ensure that the pin-shaped device assumes a non-locking position on discharge. Only on the occurrence of a retardation in conjunction with the first hit can the pin-shaped device be longitudinally displaced for interaction with the fixed portion and thereby for locking of the movable portion to the fixed portion. On the occurrence of this retardation, the ignition fuze will make safe the ammunition unit which thereafter can only be activated by shock-ignition of the secondary explosive charge because of impact on a sufficiently hard target.

BRIEF DESCRIPTION OF THE ACCOMPANYING DRAWINGS

A currently proposed embodiment of an arrangement displaying the characteristics significative of the present invention will be described in greater detail below with reference to the accompanying drawings, in which:

FIG. 1 schematically illustrates the discharge from a gun of an ammunition unit which, within the trajectory safety distance, strikes first and second objects in the form of trees;

DETAILED DESCRIPTION OF EMBODIMENT

Figure 1:
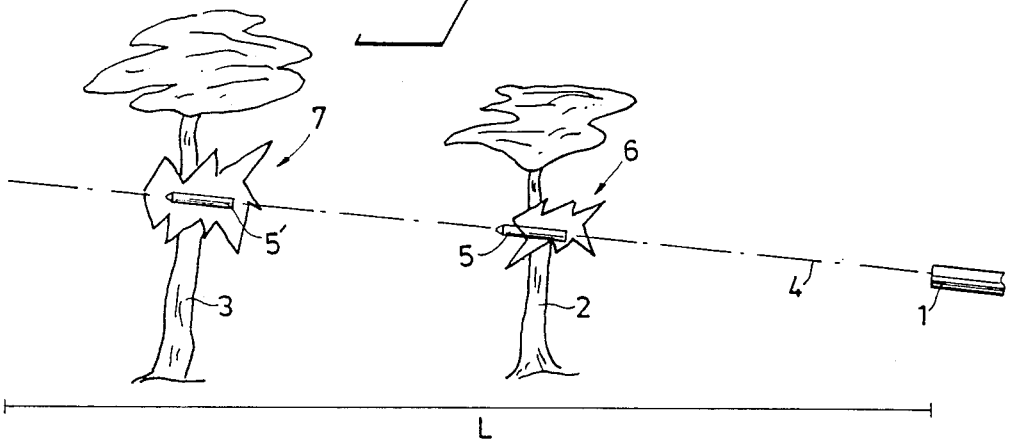

In FIG. 1, a gun or similar artillery piece is symbolized by its barrel 1. The trajectory safety distance L may be selected in a conventional manner and may be, for instance, from 50 to 150 meters. It is assumed that in the firing action under consideration here objects in the form of trees 2 and 3 are located within the trajectory safety distance L. These trees have incidently fallen in the line of fire 4 of an ammunition unit which is represented in two positions, of which the first position is designated 5 and the second position 5'. Upon discharge of the ammunition unit, a first hit 6 has occurred between the ammunition unit and the tree 2 and a second hit 7 between the ammunition unit and the tree 3.

If, in the case described with reference to FIG. 1, conventional fuzes with a trajectory safety device of the electric type are employed, it could happen that the electrical trajectory safety device and/or the electronics intended therefore could activate the arming igniter so that the ammunition unit, on the second hit 7, assumes the armed position, which would cause detonation of the ammunition unit by shock to complete explosion for bursting.

Figure 2:
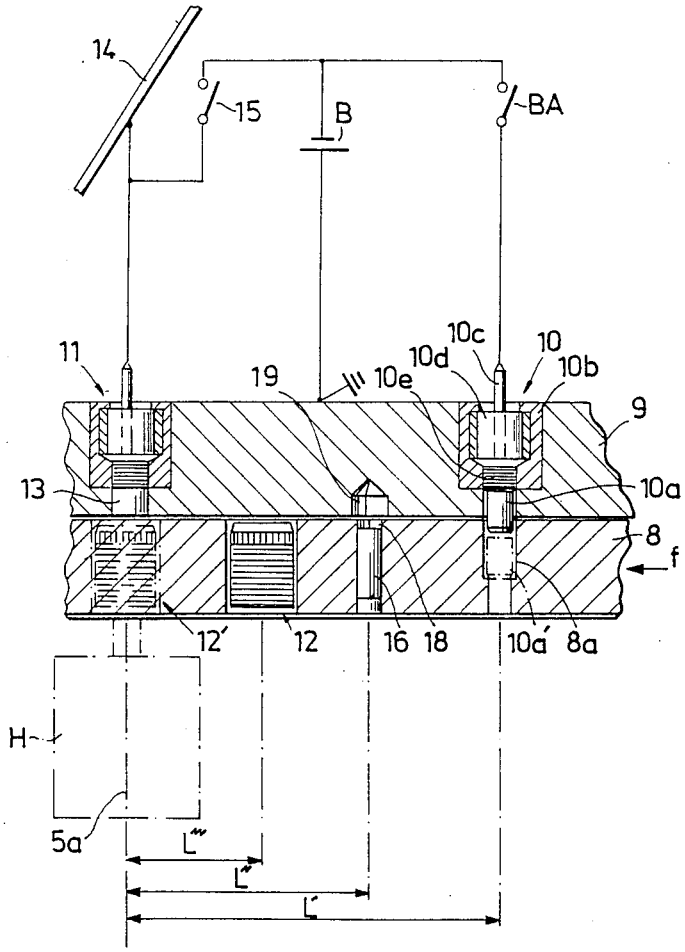
FIG. 2 shows, in partial cross-section, relevant parts of the fuze and ammunition unit in which the fuze is disposed.

FIG. 2 shows relevant parts of the ammunition unit and the mutual positions of these parts before the first hit 6. These parts, which may substantially be referred to the fuze of the ammunition unit, include a movable portion in the form of a rotor 8 rotatable around the centre axis 5*a* of the ammunition unit. The rotation may be effected with the assistance of rotational forces and/or spring force f. There are also shown on the drawing parts of a portion 9 included in the ammunition unit which are fixed in relation to the movable portion 8. The rotor is provided with an arming igniter 10 which includes a locking pin 10*a* which is disposed, within the trajectory safety distance L, to hold the movable portion 8 locked to the fixed porton 9. In the illustrated position, the pin 10*a* thus extends with portions both into the movable and the fixed portion, these portions 8 and 9 being provided with corresponding recesses. Beyond the trajectory safety distance, the arming igniter 10 is to be activated, which implies that the pin 10*a* is urged out of its interaction with one of the portions 8 and 9. In the present case, the pin 10*a* is actuated to a position in the recess 8*a* of the movable portion 8, where the pin has become disengaged from the fixed portion 9. This position of the pin 10*a* has been designated 10*a'* in FIG. 2. The activation of the arming igniter is realized with the assistance of a prior-art electric igniter 10*b* which may be actuated by a trajectory safety contact BA. Activation of the trajectory safety device takes place in conjunction with discharge of the ammunition unit from the gun 1 in a known manner, for example with the assistance of magnetic circuits which realize induction. When the contact BA is made, the electric igniter is initiated after a certain time lag, at which point the pin is displaced into the fixed portion to its position 10*a'*. The electric igniter has an electrode 10*c*, a glass body 10*d* and a pyrotechnical charge 10*e*. The charge is forced against the one end surface of the body at which electric contact means extend between the electrode 10*c* and the earthed body of the electric igniter. When the current circuit is made, electric contact means are heated and ignite the charge 10*e* which will then cause displacement of the pin 10*a*.

The fixed portion also carries an initiation detonator 11 which is also of a known electric type and is designed and operates in a manner corresponding to that of the fuze 10. In addition, the movable portion 8 carries a bursting cap 12 which is operative for instantaneous activation of a main charge H associated with the carrier. On release of the movable portion from the fixed portion, the movable portion 8 will be influenced in a known manner, such that the bursting cap is turned to a position 12' where it is placed in register with the eye 13 of the initiation fuze. In the position 12' of the bursting cap, the fuze is armed and the ammunition unit may thereafter be denotated through the intermediary of an impact contact, for example of the double shell type, and/or a proximity fuze contact 15 symbolically shown in FIG. 2, both of these respective contacts 14 and 15 appropriately consisting of known types. In the position 12', the initiation igniter is, in the illustrated case, triggerable electrically from the contact 14 or 15, respectively, upon whose activation a current circuit is made from the positive pole of the battery 8 through the intermediary of the initiation igniter and the negative pole of the battery. Triggering of the electric fuze 10 is effected in a corresponding manner through the intermediary of the positive pole of the battery, the trajectory safety contact BA and the negative pole of the battery.

The movable portion also carries a pin-shaped device 16 which serves as an extra mechanical trajectory safety device, in the event that a hit situation, for instance corresponding to that described with reference to FIG. 1, occurs. The arming safety device 10 is placed at a distance L', the trajectory safety element 16 at a distance L'' and the bursting cap 12 at a distance L''' from the axis of rotation 5*a* of the ammunition unit. Naturally, the dispositions of the different units within the movable portion may be varied without departing from the inventive concept as herein disclosed.

Figure 3:
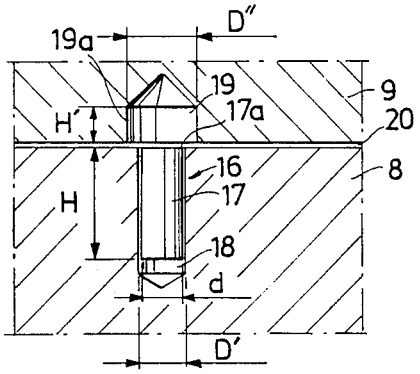
FIG. 3 shows, in cross section, a preferred embodiment of a locking device included in the fuze of FIG. 2, and functioning as a mechanical trajectory safety device which supplements the electrical trajectory safety device according to FIG. 2.

According to FIG. 3, the safety device 16 consists of a pin-shaped member 17 disposed in a recess 18 in the portion 8. A recess 19 corresponding to the recess 18 is disposed in the portion 9. The recess 18 is of a diameter D' of, for example, 0.85 mm. The diameter d of the pin 17 is less than the diameter D' by a few hundredths of the millimeter, for example by 5–10 hundredths of a millimeter. The recess 19 is of a diameter D'' which exceeds the diameter D' by approx. 10–30 percent. The pin-shaped member is of a height H of approx. 2 mm. The height H' of the recess in the portion 9 is approx. 0.5 mm. The pin-shaped member is substantially of the same length as the recess 18. When the pin-shaped member assumes the position illustrated in FIG. 3, its end surface 17*a* is substantially flush with the gap 20 between the movable and fixed portions.

Figure 4:
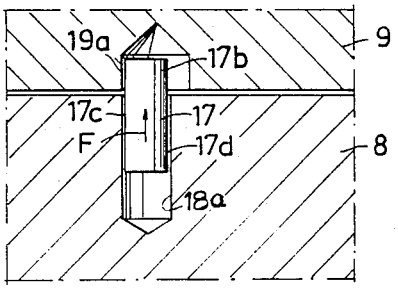
FIG. 4 shows, in cross-section, the position of the locking device in which it holds the movable and fixed portions mutually locked.

FIG. 4 shows the case in which the pin 17 has been moved by retardation forces F forwardly so that the forward parts 17*b* are located in the recess 19. Relevant parts of the circumferencial surface 17*c* interact in this instance with the walls 18*a* and 19*a* in the recesses 18 and 19. The pin 17 is retained in the position as shown in FIG. 4 as a result of the friction between the side surfaces of the pin and the walls of the recesses. This friction is realized by the rotation (centrifugal force) of the ammunition until about its longitudinal axis 5*a* (see FIG. 2).

Figure 5:
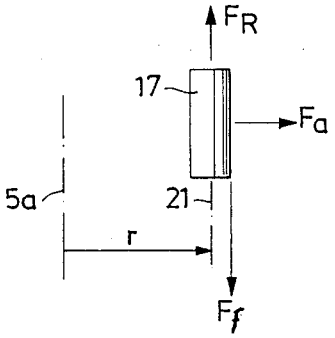
FIG. 5 shows the forces occurring on the locking device according to FIGS. 3 and 4.

FIG. 5 shows those forces which act on the pin-shaped member 17. The retardation force is designated $F_R$ and is equal to $m \cdot a_r$. The rotational force $F_a$ is equal to $m \cdot r \cdot W^2$. The frictional force $F_f = \mu \cdot m \cdot r \cdot W^2$. The distance between the centre line 21 of the pin-shaped member and the axis of rotation 5*a* is indicated in FIG. 5 by r (cf. L'' in FIG. 2). The pin-shaped member is of steel. As a result of the disclosed construction and disposition, it is possible for the pin-shaped member to move forward and lock the movable portion on the first hit 6 and retain the locking according to FIG. 4 on the second hit 7. The fuze will thereafter assume a safe position during the continued flight of the ammunition unit. The ammunition unit can nevertheless be shock-detonated by direct impact on a target.

The pin-shaped member can be retained in its locking position for the movable portion by means of torque forces f on the movable portion. These torque forces f can form an alternative or supplementary locking force to the locking forces mentioned in the foregoing which are obtained from the rotation.

The present invention should not be considered as restricted to that described above and shown on the drawings, many modifications being conceivable without departing from the spirit and scope of the appended claims.

What we claim and desire to secure by letters patent is:

1. A fuze arrangement for an ammunition unit dischargeable from a gun, in which the fuze includes electronics with an associated electrical trajectory safety device for preventing arming of the ammunition unit within a trajectory safety distance, an arming igniter actuable by the trajectory safety device after the trajectory safety distance, and a movable portion which is actuable by the arming igniter for executing an instantaneous movement to move a bursting cap disposed in the movable portion to the arming position in a detonation chain including a initiation detonator actuable by means of an impact or a proximity fuze contact;

wherein the movable portion is lockable by a locking device, which is actuable on a first hit of the ammunition unit against an object located within the trajectory safety distance for preventing the movable portion from executing the instantaneous movement even if the first hit mechanically influences electronics and/or the electrical trajectory safety device to effect activation of the arming igniter, such that the ammunition unit, upon a second hit against a further object within the trajectory safety distance, assumes the safe secured position, thereby preventing total bursting of the ammunition unit by the shock-triggering of the bursting cap on the second hit.

2. The arrangement according to claim 1, wherein the locking device comprises a pin-shaped member.

3. The arrangement according to claim 2, wherein the pin-shaped member is disposed in the movable portion in a first recess extending in the longitudinal direction of the ammunition unit, the first recess being disposed opposing a second recess provided in a fixed portion of the ammunition unit.

4. The arrangement according to claim 3, wherein the pin-shaped member is disposed in the first recess with a clearance of about a few hundredths of a millimeter, such as to be loosely displaceable in the recess upon a retardation caused by the first hit.

5. The arrangement according to claim 3, wherein the pin-shaped member, upon a retardation, caused by the first hit, is longitudinally displaced to enter into interaction with the fixed portion and to penetrate with its forward portion into the second recess.

6. The arrangement according to claim 5, wherein the second recess has a diameter which exceeds the diameter of the first recess by about 10–30 percent.

7. The arrangement according to claim 2, wherein the first and second recesses, in an initial position of the movable portion, are disposed opposing one another, such that the center lines of the recesses substantially coincide.

8. The arrangement according to claim 7, wherein the pin-shaped member and the first and second recesses are located aside the axis of rotation of the ammunition unit.

9. The arrangement according to claim 8, wherein the side surfaces on parts of the pin-shaped member disposed in the first and second recesses are adapted to interact with surfaces of the first and second recesses for locking the movable portion to the fixed portion.

10. The arrangement according to claim 9, wherein the locking device is maintained in a non-locking position in the movable portion due to acceleration of the ammunition unit, and is actuated for longitudinal displacement of the pin-shaped member into the fixed portion upon a retardation, longitudinal displacement movement and/or rotational movement of the ammunition unit effected by the first hit.

* * * * *